72-345
10/15/85 OR 4,546,635

United States Patent [19]

Arita et al.

[11] Patent Number: 4,546,635

[45] Date of Patent: Oct. 15, 1985

[54] APPARATUS FOR FORMING GEARS

[76] Inventors: Masashi Arita, 1028-3725, Kaminakazato-cho, Isogo-ku, Yokohama-shi, Kanagawa-ken; Shigeo Nakazawa, 617-45, Obuchi, Fuji-shi, Shizuoka-ken, both of Japan

[21] Appl. No.: 456,785

[22] Filed: Jan. 10, 1983

[30] Foreign Application Priority Data

Mar. 16, 1982 [JP] Japan ..... 57-40279

[51] Int. Cl.[4] ..... B21C 23/00

[52] U.S. Cl. ..... 72/345; 72/256

[58] Field of Search ..... 83/98, 99; 72/95, 343, 72/344, 345, 256; 29/159.2

[56] References Cited

U.S. PATENT DOCUMENTS

| | | | |
|---|---|---|---|
| 2,251,135 | 7/1941 | Iknayan | 83/98 |
| 3,605,475 | 9/1971 | Eakin et al. | 72/256 |
| 3,813,909 | 6/1974 | Roger | 72/95 |
| 3,910,091 | 10/1975 | Samanta | 72/256 |
| 4,425,829 | 1/1984 | Kranik | 83/89 |
| 4,509,353 | 4/1985 | Ike | 72/267 |

*Primary Examiner*—Leon Gilden

[57] ABSTRACT

A gear is formed in a gear-forming apparatus including a die block formed with an axial bore and a plurality of teeth radially projecting into the bore and having lead-in portions adjacent one axial end of the bore, and an elongated mandrel axially movable into the bore, by placing at least one blank in position outside the die block and adjacent the axial end of the bore, causing the mandrel to extend through the center hole in the blank; forcing the blank into the bore from the axial end of the bore until the blank is moved past the teeth of the die block so that the blank is caused to form gear teeth on its outer peripheral surface by the teeth of the die block; driving at least one of the die block and the mandrel to move with respect to each other so that the gear resulting from the blank is withdrawn together with the mandrel out of the bore in the die block; and removing the gear from the mandrel outside the die block.

4 Claims, 7 Drawing Figures

APPARATUS FOR FORMING GEARS

FIELD OF THE INVENTION

The present invention relates to a method of forming gears by extrusion of a blank and an apparatus to carry out the method.

SUMMARY OF THE INVENTION

In accordance with one outstanding aspect of the present invention, there is provided a method of forming a gear in a gear-forming apparatus including a die block formed with an axial bore and a plurality of teeth radially projecting into the bore and having lead-in portions adjacent one axial end of the bore, and an elongated mandrel axially movable into the bore, comprising preparing at least one annular blank having a center hole and a predetermined outside diameter, placing the blank in position outside the die block and adjacent the aforesaid axial end of the bore in the die block, causing the mandrel to axially extend through the center hole in the blank; forcing the blank into the bore in the die block from the axial end of the bore until the blank is moved past the teeth of the die block so that the blank is caused to form gear teeth on its outer peripheral surface by the teeth of the die block; driving at least one of the die block and the mandrel to move with respect to each other so that the gear resulting from the blank is withdrawn together with the mandrel out of the bore in the die block; and removing the gear from the mandrel outside the die block. More specifically, a method according to the present invention may comprise preparing a plurality of annular blanks each having a center hole and a predetermined outside diameter, placing at least two of the blanks in position outside the die block and adjacent the axial end of the bore in the die block, causing the mandrel to axially extend through the center hole in at least the foremost one of the blanks; successively forcing the blanks into the bore in the die block from the axial end of the bore so that at least the foremost one of the blanks is caused to form gear teeth on its outer peripheral surface by the teeth of the die block; driving at least one of the die block and the mandrel to move with respect to each other so that the gear resulting from the blank is withdrawn together with the mandrel out of the bore in the die block; removing the gear from the mandrel outside the die block; placing at least one subsequent blank in position outside the die block and adjacent the axial end of the bore in the die block, causing the mandrel to axially extend through the center hole in the blank remaining in the bore in the die block; forcing the subsequent blank into the bore in the die block from said axial end of the bore and pressing the subsequent blank against the blank remaining in the bore in the die block so that at least the foremost one of the blanks in the die block is caused to form gear teeth on its outer peripheral surface by the teeth of the die block; driving at least one of the die block and the mandrel to move with respect to each other so that the gear resulting from the blank is withdrawn together with the mandrel out of the bore in the die block; and removing the resultant gear from the mandrel outside the die block.

In accordance with another outstanding aspect of the present invention, there is provided a gear-forming apparatus, comprising a die block formed with an axial bore and a plurality of teeth radially projecting into the bore and having lead-in portions adjacent one axial end of the bore; a pressing member movable into and out of the bore in the die block through one axial end of the bore; an elongated mandrel movable into and out of the bore in the die block through the other axial end of the bore; and gear withdraw means adapted to remove and withdraw a gear from the mandrel. More specifically, an apparatus according to the present invention may comprise a support block formed with an axial bore and a passageway leading from the bore in the support block and open to the outside of the support block, a lower backup member fixed with respect to the support block and formed with an opening which is adjacent at one axial end thereof to the bore in the support block, a die block fixed with respect to the lower backup member and formed with an axial bore and a plurality of teeth radially projecting into the bore and having lead-in portions adjacent one axial end of the bore in the die block, the bore in the die block being open at one axial end thereof to the opening in the lower backup member through the other axial end of the opening, a bearing member fixed with respect to the die block and formed with an axial bore substantially aligned with and equal in diameter to the bore in the die block, the bore in the bearing member being open at one end thereof to the bore in the die block through the other end of the bore in the die block, and a guide block fixed with respect to the support block and formed with an axial bore substantially aligned with the respective bores in the die block and the bearing member; a punch assembly movable forwardly toward and rearwardly away from the guide block and comprising a pressing member axially slidable into and out of the bore in the bearing member through the other axial end of the bore in the bearing member; and an elongated mandrel movable into and out of the bore in the die block through the bore in the guide block and the bore in the die assembly; and gear withdraw means adapted to remove and withdraw a gear from the bore in the support block through the above mentioned passageway.

BRIEF DESCRIPTION OF THE DRAWINGS

The drawbacks of a prior-art method of and an apparatus for forming gears and the features and advantages of a method of and an apparatus for forming gears according to the present invention will be more clearly understood from the following description taken in conjunction with the accompanying drawings in which.

DESCRIPTION OF THE PRIOR ART

Figure 1:
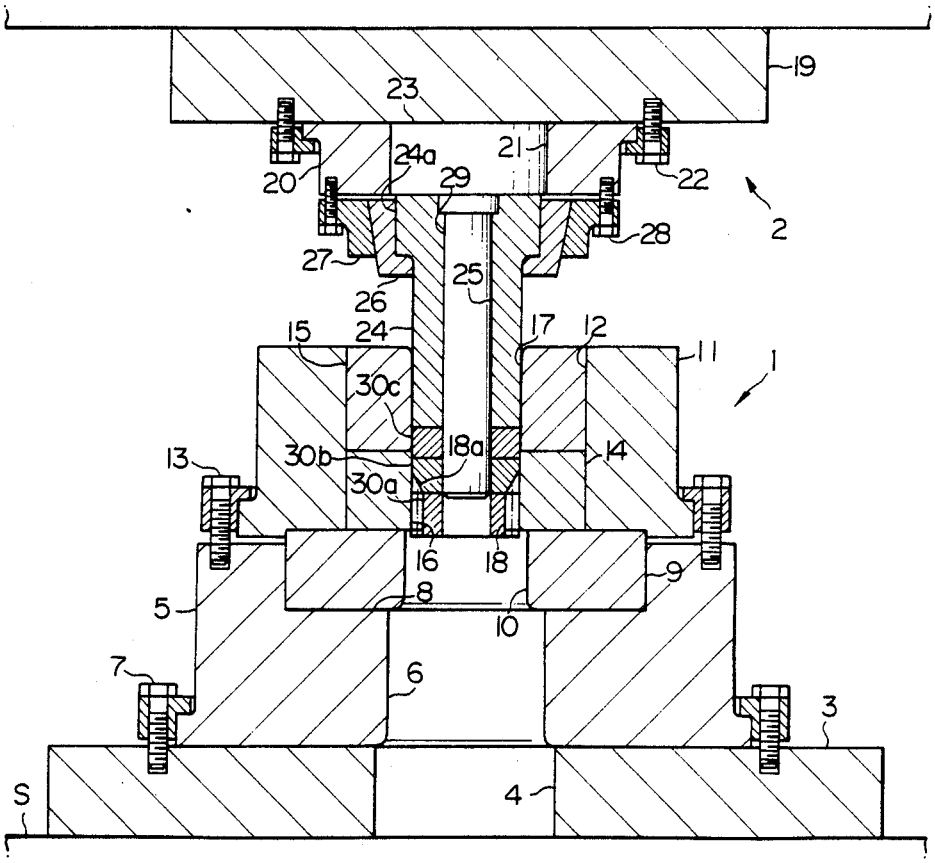
FIG. 1 PRIOR ART
FIGS. 1 and 2 are vertical sectional views showing an example of a prior-art gear-forming apparatus of the nature to which the present invention appertains.
Figure 2:
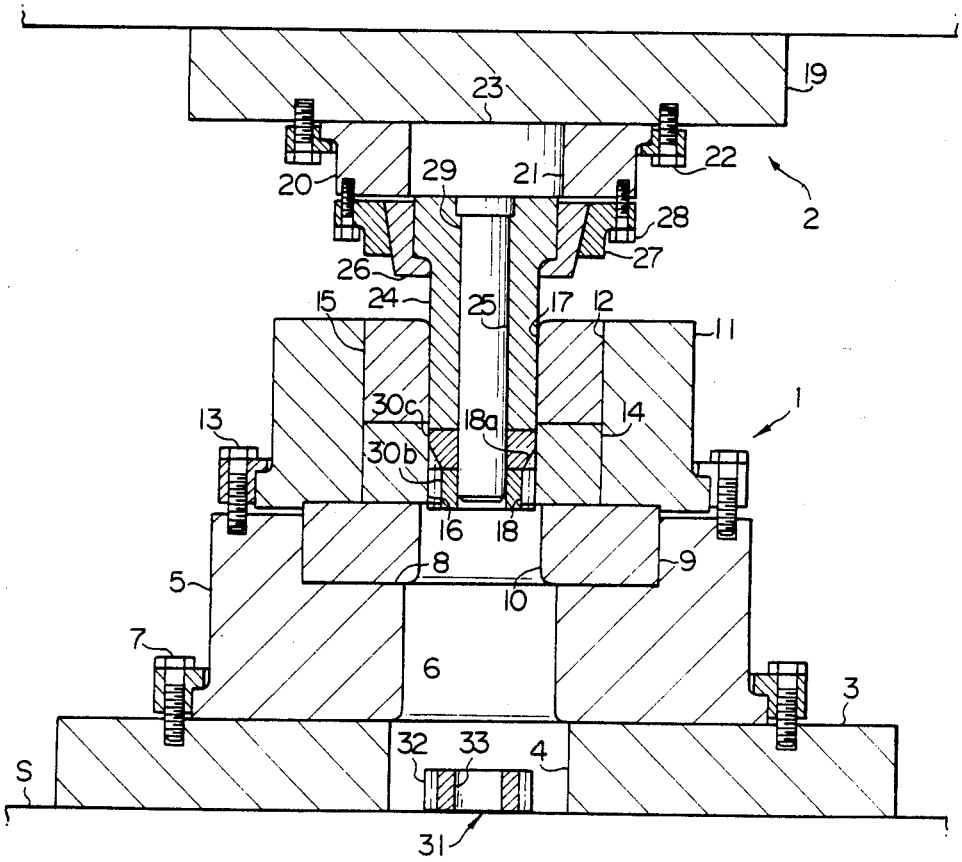
FIG. 2 PRIOR ART

Referring to FIGS. 1 and 2 of the drawings, a prior-art gear-forming apparatus consists of a lower stationary die assembly 1 and an upper movable punch assembly 2 which is positioned above the stationary die assembly and which is in its entirety movable downwardly toward and upwardly away from the stationary die assembly 1. The stationary die assembly 1 comprises a lower base plate 3 fixedly positioned on a floor surface S and formed with an opening 4. The lower base plate 3 has fixedly mounted thereon a support block 5 formed with a bore 6 aligned with and open at the lower end thereof to the opening 4 in the base plate 3. The support block 5 has a lower flange portion formed with threaded holes through which bolts 7 are screwed into the base plate 3. The support block 5 is further formed with an annular upper depression 8 which is open upwardly. An annular lower backup member 9 is closely received in this annular depression 8 and is formed with an opening 10 open at the lower end thereof to the bore 6 in the support block 5. The lower backup member 9 in turn has supported thereon a cylindrical bearing socket member 11 formed with a bore 12 aligned with the opening 10 in the lower backup member 9, the bore 6 in the support block 5 and the opening 4 in the base plate 3. The bearing socket member 11 also has a lower flange portion formed with threaded holes through which bolts 13 are screwed into the support block 5. An annular die block 14 is closely received on the inner peripheral surface of the bearing socket member 11 and on the upper face of the lower backup member 9. A bearing ring 15 is likewise closely received on the inner peripheral surface of the bearing socket member 11 and on the upper face of the die block 14. The die block 14 and bearing ring 15 are formed with bores 16 and 17, respectively, having predetermined equal diameters. The bore 16 in the die block 14 is open at the lower end thereof to the opening 10 in the lower backup member 9 and, likewise, the bore 17 in the bearing ring 15 is open at the lower end thereof to the bore 16 in the die block 14. The die block 14 is formed with helical teeth 18 radially projecting into the bore 16 in the block 14 and having lead-in portions **18*a* located adjacent the upper end of the die block 14 and having heights gradually reduced toward the bore 17 in the bearing ring 15** as shown.

On the other hand, the punch assembly 2 comprises an upper bolster 19 positioned and vertically movable above the die assembly 1. The upper bolster 19 has fixedly attached to the lower face thereof an annular retainer block 20 formed with an opening 21. The retainer block 20 has a lower flange portion formed with threaded holes through which bolts 22 are screwed into the bolster 19. An upper backup member 23 is closely received in the opening 21 in the retainer block 20 and has a generally cylindrical punch sleeve 24 fixedly attached to the lower face of the backup member 23. The punch sleeve 24 is formed with a bore 25 having a predetermined diameter. The punch sleeve 24 has a radially enlarged upper end portion **24*a* and is fixedly attached to the lower backup member 23 by means of an inner locking ring 26 engaging the enlarged upper end portion 24*a* of the sleeve 24 and having a frusto-conical outer peripheral surface tapering downwardly and an outer locking ring 27 having a frusto-conical inner peripheral surface closely received on the frusto-conical outer peripheral surface of the inner locking ring 26. The outer locking ring 27 has an upper flange portion formed with threaded holes through which bolts 28 are screwed into the retainer block 20 so that the inner and outer locking rings 26 and 27 and accordingly the punch sleeve 24 are fixedly secured to the retainer block 20. An elongated mandrel 29 is closely received in the bore 25 in the punch sleeve 24 and has an upper end face bearing against the lower face of the lower backup member 23. The mandrel 29 has a lower end portion which projects downwardly from the bore 25 in the punch sleeve 24 and which is axially movable through the bores 16 and 17 in the die block 14 and bearing ring 15**.

To fabricate helical gears from blanks in the prior-art gear-forming apparatus having the construction above described, the upper punch assembly 2 is first held in a predetermined upper limit position above the lower die assembly 1 so that the punch sleeve 24 and the mandrel 29 of the punch assembly 2 are withdrawn upwardly from the bores 16 and 17 in the die block 14 and the bearing ring 15 of the die assembly 1. A suitable number of annular blanks **30*a*, 30*b* and 30*c* are put into the bore 17 in the bearing ring 15. Of these blanks 30*a*, 30*b* and 30*c*, the lowermost blank 30*a* is positioned in close proximity to the lead-in portions 18*a* of the teeth 18 of the die block 14. The punch assembly 2 as a whole is then driven to move downwardly so that the punch sleeve 24 is moved into the bore 17 in the bearing ring 15 and is brought into abutting contact at its lower end face with the upper end face of the uppermost blank 30*c* in the bore 17. Under these conditions, the mandrel 29 of the punch assembly 2 extends downwardly through the center holes in the individual blank 30*a*, 30*b* and 30*c* and projects from the lowermost blank 30*a* into the bore 16 in the die block 14. As the punch assembly 2 is further driven to move downwardly, the lowermost blank 30*a* is forced to enter the bore 16 in the die block 14 and to form helical teeth progressively between the lead-in portions 18*a* of the helical gear of the die block 14. The lowermost blank 30*a* is further forced to move through the bore 16 in the die block 14 and is caused to finally form the helical gear teeth thereon by the teeth 18 of the die block 14 and is allowed to fall out of the bore 16 in the die block 14. A helical gear 31 having helically extending teeth 32 and a center hole 33 is thus withdrawn from the die block 14 into the opening 4 in the base plate 3 through the opening 10 in the lower backup member 9 and the bore 6 in the support block 5 as shown in FIG. 2. While the lowermost blank 30*a* is being forced through the bore 16 in the die block 14, the subsequent blank 30*b* is forced into the bore 16 and is deformed into the form of a helical gear as above described. The uppermost blank 30*c* is thus deformed into a helical gear by the time when the upper punch assembly 2 reaches a predetermined lower limit position with respect to the lower die assembly 1**. A number of helical gears are produced by repetition of the above described cycle of operation.

Figure 3:
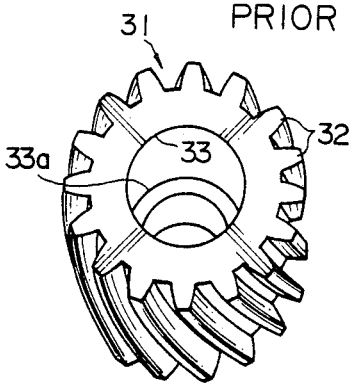
FIG. 3 PRIOR ART
FIG. 3 is a perspective view showing an example of the helical gears produced by the prior-art apparatus for forming gears shown in FIGS. 1 and 2.
Figure 4:
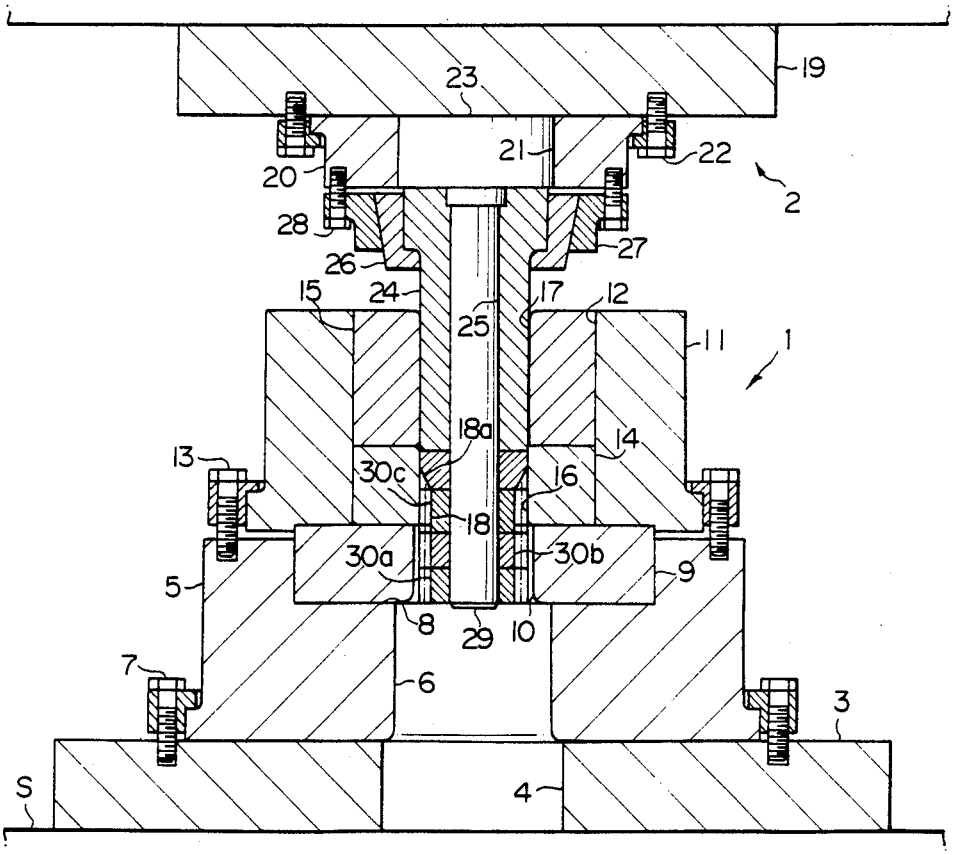
FIG. 4 PRIOR ART
FIG. 4 is a vertical sectional view showing a modification of the prior-art apparatus forming gears shown in FIGS. 1 and 2.

When a plurality of blanks are to be worked concurrently in the die assembly 1 during each cycle of operation of the gear-forming apparatus as above described, it is important that the mandrel 29 of the punch assembly 2 extend downwardly beyond the lead-in portions **18*a* of the teeth 18 of the die block 14. If the mandrel 29 terminates halfway of the lead-in portions 18*a* of the teeth 18, the blank being forced to form teeth thereon by the lead-in portions 18*a* of the teeth 18 are caused to deform toward the center axis of the blank in the absence of the mandrel 29 extending through the center hole in the blank. Such deformation of the blank results not only in deviation of the teeth but in formation of an annular shoulder portion in the center hole in the resultant helical gear as indicated at 33*a* in FIG. 3. If the punch assembly 2 is designed in such a manner that the mandrel 29 extends sufficiently beyond the lead-in portions 18*a* of the teeth 18 of the die block 14, these problems could be avoided but another problem is encountered in that the gears formed in the die block 14 are held on a lower end portion of the mandrel 29 projecting past the bore 16 in the die block 14 into the opening in the lower backup member 9 when the punch assembly 2 is moved to the lower limit position with respect to the die assembly 1 as shown in FIG. 4 of the drawings. When the punch assembly 2 is thereafter driven to move upwardly, the uppermost one of the gears thus retained to the mandrel 29 is brought into abutting contact with the teeth 18 of the die block 14 so that the blanks are disengaged one by one from the mandrel 29 which is moving upwardly with respect to the die block 14. The teeth 18 of the die block 14 thus impinged upon by the uppermost one of the blanks on the mandrel 29 are subjected to bending stresses directed opposite to the bending stresses produced in the teeth 18 during formation of the teeth on each of the blanks. This results in early breakage of the teeth 18 of the die block 14. Experiments show that, when two blanks are worked in each cycle of operation, the teeth 18 of the die block 14 are partially broken when 800 gears are formed. When one blank is worked in each cycle of operation, the the teeth 18 of the die block 14 stay undamaged until 5000 gears are produced. It has thus proved that a prior-art gear-forming apparatus of the nature described with reference to FIGS. 1 and 2** is not fully acceptable for the purpose of forming a plurality of gears in each cycle of operation.

The present invention contemplates resolution of these problems encountered in a prior-art gear-forming apparatus of the described nature.

DESCRIPTION OF THE PREFERRED EMBODIMENT

Figure 5:
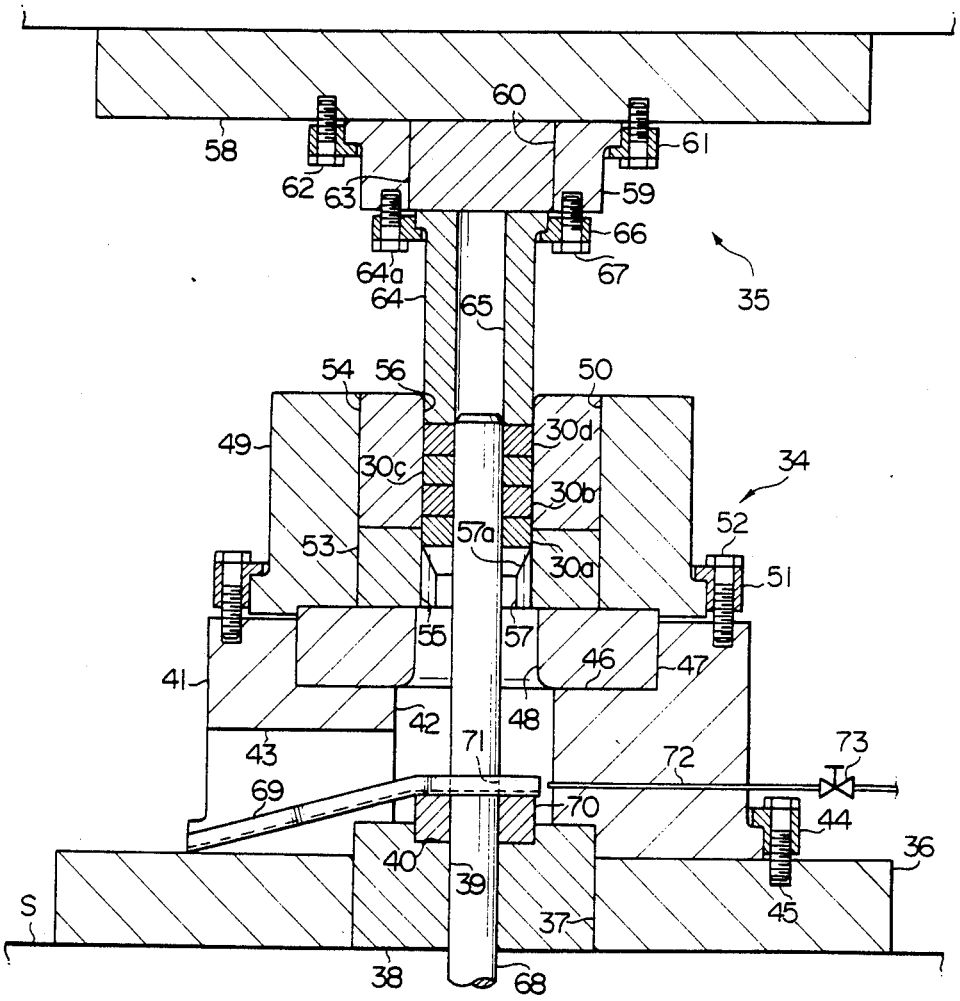
FIGS. 5, 6 and 7 are vertical sectional views showing a preferred embodiment of the apparatus for forming gears according to the present invention.
Figure 6:
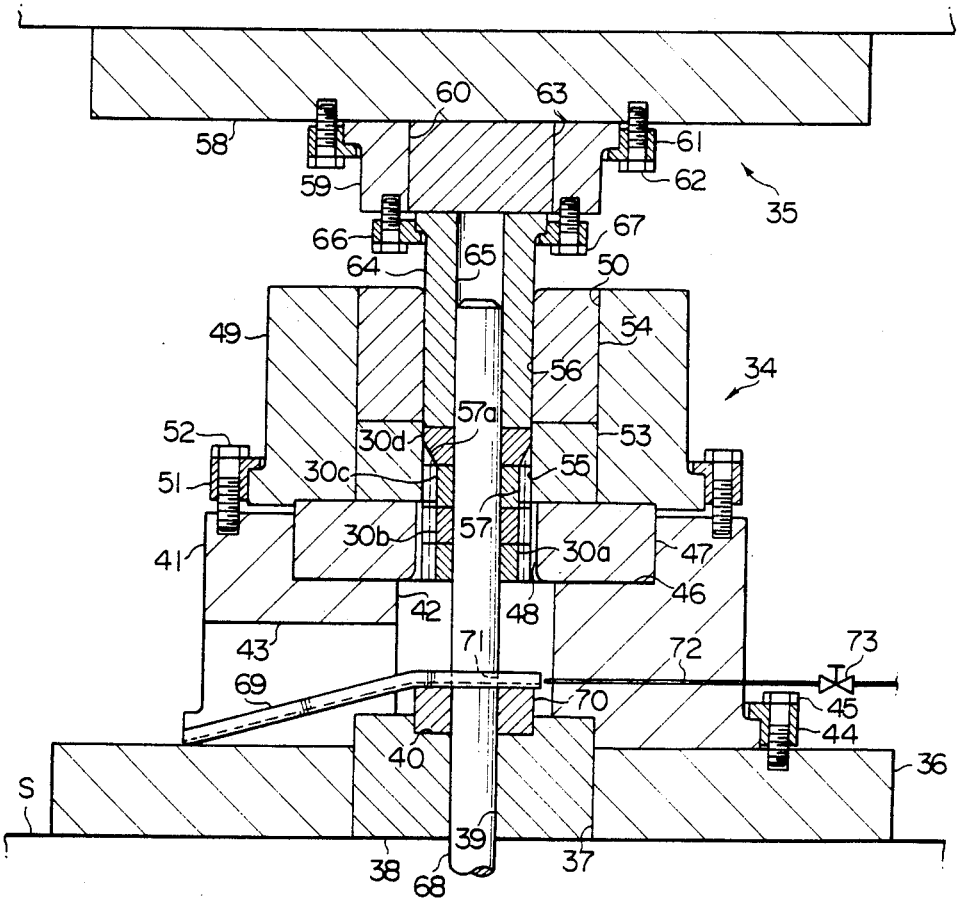
Figure 7:
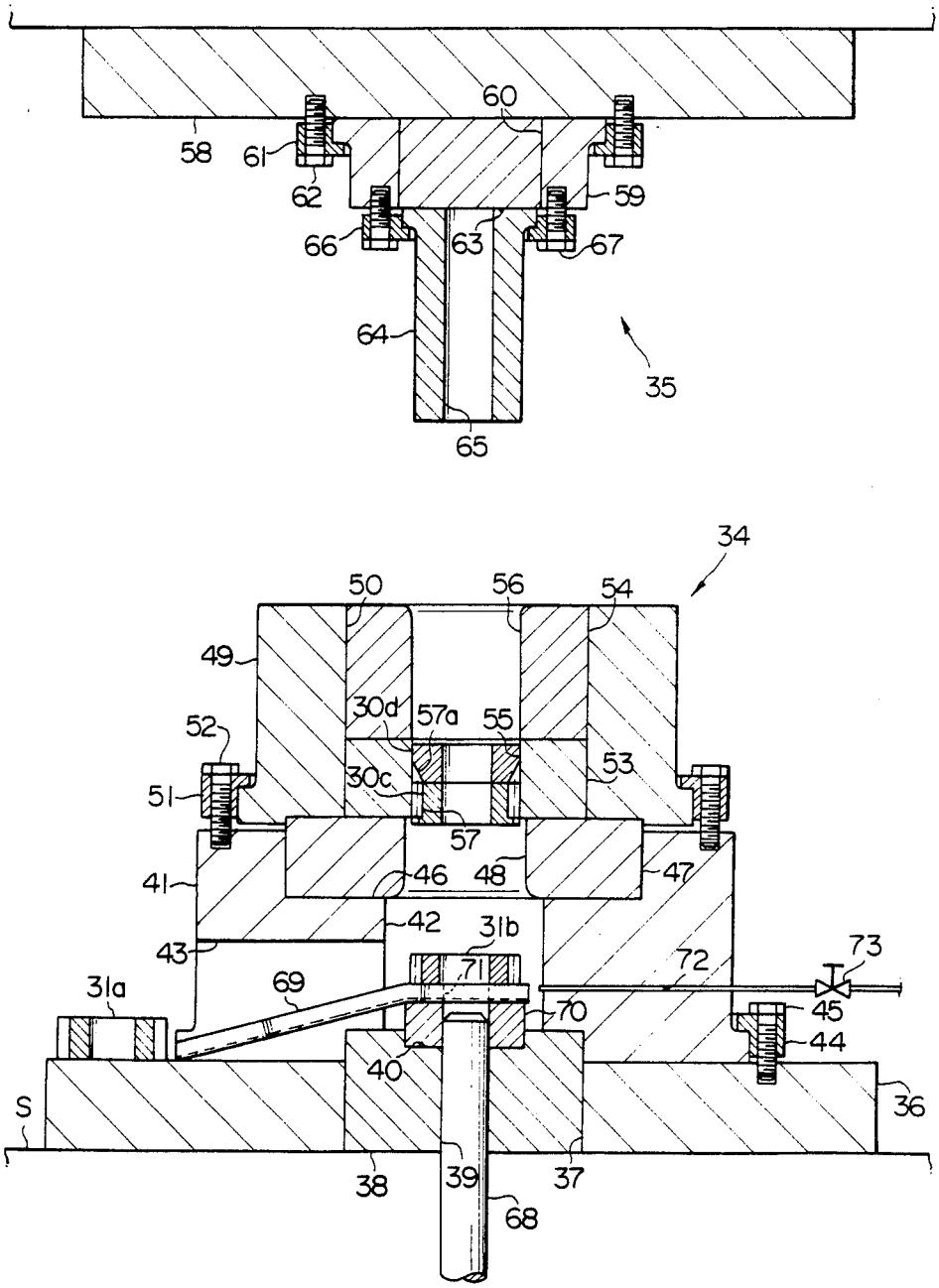

Referring to FIGS. 5, 6 and 7 of the drawings, a gearforming apparatus embodying the present invention comprises a lower stationary die assembly 34 and an upper movable punch assembly 35 which is positioned above the stationary die assembly 34 and which is in its entirety movable downwardly toward and upwardly away from the stationary die assembly 34. The stationary die assembly 34 comprises a lower base plate 36 fixedly positioned on a floor surface S formed with an opening 37 having a circular cross section and a vertical center axis. A cylindrical guide block 38 having an outside diameter substantially equal to the inside diameter of the base plate 36 is closely received in the opening 37 in the plate 36 and slightly projects upwardly from the base plate 36. The guide block 38 is formed with a vertical bore 39 having a circular cross section with a predetermined diameter and has an upper wall portion formed with a depression 40 which is open upwardly. The lower base plate 36 has fixedly mounted thereon a support block 41 formed with a vertical bore 42 terminating at the upper end face of the guide block 38 and a radial passageway 43 extending radially outwardly from the bore 42 and open at the outer peripheral end of the support block 41. The support block 41 has a lower flange portion received in an annular locking ring 44 formed with threaded holes through which bolts 45 are screwed into the base plate 36 so as to have the support block 41 secured to the base plate 36. The support block 41 is further formed with an annular upper depression 46 which is open upwardly and which coaxially surrounds an upper end portion of the bore 42 in the support block 41. An annular lower backup member 47 having a horizontal flat upper face is closely received in this annular depression 46 and is formed with an opening 48 having a circular cross section and axially aligned with and open at the lower end thereof to the bore 42 in the support block 41. The lower backup member 47 in turn has supported on the upper end face thereof a cylindrical bearing socket member 49 formed with a bore 50 which is axially aligned with the opening 48 in the lower backup member 47 and the bore 42 in the support block 41. The bearing socket member 49 also has a lower flange portion received in an annular locking ring 51 formed with threaded holes through which bolts 52 are screwed into the support block 41 so as to have the bearing socket member 49 secured to the support block 41. An annular die block 53 is closely received on a lower portion of the inner peripheral surface of the bearing socket member 49 and on the upper face of the lower backup member 47. A bearing ring 54 is likewise closely received on an upper portion of the inner peripheral surface of the bearing socket member 49 and on the upper face of the die block 53. The die block 53 and bearing ring 54 are formed with bores 55 and 56, respectively, having circular cross sections with predetermined equal diameters not smaller than the opening 48 in the lower backup member 47 and the bore 42 in the support block 41. The bore 55 in the die block 53 is open at the lower end thereof to the opening 48 in the lower backup member 47 and, likewise, the bore 56 in the bearing ring 54 is open at the lower end thereof to the bore 55 in the die block 53. The die block 53 is formed with helical teeth 57 radially projecting into the bore 55 in the block 53 and having lead-in portions **57*a* which are located adjacent the upper end of the die block 53 and which have heights gradually reduced toward the bore 56 in the bearing ring 54** as shown.

On the other hand, the punch assembly 35 comprises an upper bolster 58 positioned and vertically movable above the die assembly 34. The upper bolster 58 has fixedly attached to the lower face thereof an annular retainer block 59 formed with an opening 60 having a circular cross section and a vertical center axis. The retainer block 59 has a lower flange portion received in a locking ring 61 formed with threaded holes through which bolts 62 are screwed into the bolster 58. A cylindrical upper backup member 63 having a diameter substantially equal to the inside diameter of the retainer block 59 is closely received in the opening 60 in the block 59 and has a generally cylindrical punch sleeve 64 fixedly attached to the lower face thereof. The punch sleeve 64 has a flat lower end face and is formed with an bore 65 having a circular cross section with a predetermined diameter and a center axis aligned with the respective center axes of the bores 55 and 56 in the die block 53 and bearing ring 54, respectively, and the center axis of the bore 39 in the guide block 38 of the above described die assembly 34. The punch sleeve 64 has a radially enlarged upper end portion **64*a* and is fixedly attached to the lower face of the lower backup member 63 by means of a locking ring 66 engaging with the enlarged upper end portion 64*a* of the sleeve 64 and formed with threaded holes through which bolts 67 are screwed into the retainer block 59 so as to have the punch sleeve 64 are fixedly secured to the retainer block 59. Though not shown in the drawings, the upper bolster 58 is operatively connected to suitable drive means adapted to drive the punch assembly 35 for vertical movement between predetermined upper and lower limit positions with respect to the lower die assembly 34. The gear-forming apparatus embodying the present invention further comprises an elongated mandrel 68 is axially slidable through the bore 39 in the guide block 38 into and out of the bore 65 in the mandrel 68 through the bores 55 and 56 in the die block 53 and bearing ring 54, respectively, the opening 48 in the lower backup member 47 and the bore 42 in the support block 41. The center axis of the mandrel 68 is aligned with the respective center axes of the bores 55 and 56 in the die block 53 and bearing ring 54**.

The punch sleeve 64 has an outer peripheral surface having a diameter substantially equal to the diameters of the respective bores 55 and 56 in the die block 53 and bearing ring 54 so that the punch sleeve 64 is axially slidable through the bores 55 and 56 therein. The outside diameter of the punch sleeve 64 and accordingly the inside diameters of the die block 53 and bearing ring 54 are substantially equal to the diameter of the helical gear or, more exactly, the diameter of the addendum circle of the gear to be formed. Furthermore, the inside diameters of the guide block 38 and punch sleeve 64, respectively. and accordingly the diameter of the mandrel 68 are selected to be substantially equal to the diameter of the center holes of the helical gears to be formed. Such gears are thus fabricated from blanks which are preliminarily worked to have outside diameters slightly smaller than the inside diameters of the die block 53 and bearing ring 54 and the outside diameter of the punch sleeve 64 and inside diameters slightly larger than the inside and outside diameters of the punch sleeve 64 and mandrel 68, respectively. Though not shown in the drawings, the mandrel 68 is operatively connected to suitable drive means adapted to drive the mandrel 68 for vertical movement between predetermined upper and lower limit positions with respect to the die assembly 34 through the bore 39 in the guide block 38.

The gear-forming apparatus embodying the present invention further comprise gear withdraw means operative to remove gears from the mandrel 68 and to discharge the gears from the bore 42 in the support block 41 to the outside of die assembly 34 through the passageway 43 in the support block 41. In the embodiment herein shown, such gear withdraw means comprises a chute member 69 partially positioned within the bore 42 in the support block 41 and partially extending downwardly and radially outwardly in the passageway 43 in the support block 41. The chute member 69 is fixedly received on a support member 70 having a lower end portion received in the depression 40 in the guide block 38 and protruding upwardly into the bore 42 in the support block 41 and is formed with an opening 71 allowing the mandrel 68 to slidably extend therethrough. The support block 41 is formed with a fluid passageway 72 which is open into the bore 42 in the block 41 in a direction perpendicular to the direction in which the mandrel 68 extends through the bore 42. The fluid passageway 72 is communicatable with a source of fluid under pressure across a solenoid-operated fluid shut-off valve 73.

To fabricate helical gears from blanks in the gear-forming apparatus having the construction above described, the upper punch assembly 35 is first held in the predetermined upper limit position with respect to the die assembly 34 and the mandrel 68 is held in the predetermined lower limit position with respect to the die assembly 34. The punch sleeve 64 held in the upper limit position thereof has the punch sleeve 64 positioned above the bore 56 in the bearing socket member 49, while the mandrel 68 held in the lower limit position thereof has its upper end located below the opening 71 in the chute member 69. A suitable number of annular blanks such as, for example, four blanks **30*a*, 30*b*, 30*c* and 30*d* each worked preliminarily as above described and having a center hole therein are put into the bore 56 in the bearing ring 54. Of the blanks 30*a*, 30*b* 30*c* and 30*d* thus put into the bore 56 in the bearing ring 54, the lowermost blank 30*a* is positioned in close proximity to the lead-in portions 57*a* of the teeth 57 of the die block 53. The drive means connected to the mandrel 68 is then actuated to drive the mandrel 68 for movement from the lower limit position to the upper limit position thereof. The upper limit position of the mandrel 68 is such that the mandrel 68 moved to the particular position extends through the center holes in at least lower two of the blanks 30*a*, 30*b*, 30*c* and 30*d*. Thus, the mandrel 68 in the upper limit position thereof may upwardly extend through the center holes of all the blanks 30*a*, 30*b*, 30*c* and 30*d* as shown in FIG. 5. The mandrel 68 may otherwise have its upper end received in one of the upper two of the blanks 30*a*, 30*b*, 30*c* and 30*d* in the bore 56 in the bearing ring 54 and upwardly extend through the center holes in the lower two or three of the blanks 30*a*, 30*b* 30*c* and 30*d*. If desired, the blanks 30*a*, 30*b* 30*c* and 30*d* may be put into the bore 56 in the bearing ring 54 after the mandrel 68 is driven to move to the upper limit position thereof. The drive means connected to the upper bolster 58 is then actuated to drive the punch assembly 35 for downward movement from the upper limit position toward the lower limit position thereof so that the punch sleeve 64 is moved into the bore 56 in the bearing ring 54 and is brought into abutting contact at its lower end face with the upper end face of the uppermost blank 30*d* in the bore 56 as shown in FIG. 6. As the punch assembly 35 is further driven to move downwardly toward the lower limit position thereof, the lowermost blank 30*a* is forced to enter the bore 55 in the die block 53 and to form helical teeth thereon progressively between the lead-in portions 57*a* of the helical gear of the die block 53. The lowermost blank 30*a* is further forced to move through the bore 55 in the die block 53 and is caused to form the helical gear teeth thereon finally by the teeth 57 of the die block 53. The blank 30*a* thus formed with the gear teeth is forced out of the bore 55 into the opening 48 in the lower backup member 47. While the lowermost blank 30*a* is being forced through the bore 55 in the die block 53, the subsequent, viz., second lowermost blank 30*b* is forced into the bore 55 and is caused to form helical gear teeth thereon. After the second lowermost blank 30*b* is withdrawn downwardly out of the bore 55 in the die block 53, the third lowermost blank 30*c* is forced into the bore 55 and is similarly caused to form helical gear teeth therein, as shown in FIG. 7. The lower three blanks 30*a*, 30*b* and 30*c* are thus caused to enter the bore 55 in the die block 53 in succession and are deformed into the forms of helical gears 31*a*, 31*b* and 31*c*, respectively, by the time when the upper punch assembly 35 reaches the predetermined lower limit position thereof. While the blanks 30*a*, 30*b* and 30*c* are being successively formed with gear teeth in these manners, the mandrel 68 is maintained in the upper limit position thereof so that the gears 31*a*, 31*b* and 31*c* respectively resulting from the individual blanks 30*a*, 30*b* and 30*c* are retained to the mandrel 68. After the last one of the blanks 30*a*, 30*b*, 30*c* and 30*d* is admitted into the bore 55 in the die block 53 and is received on the lead-in portions 57*a* of the teeth 57 of the die block 53, the drive means for the punch assembly 35 is actuated to drive the punch assembly 35 for upward movement from the lower limit position back to the upper limit position thereof and, concurrently, the drive means for the mandrel 68 is actuated to drive the mandrel 68 for downward movement from the upper limit position back to the lower limit position thereof, with the gear 31***c* resulting from the third lowermost blank 30*c* left in the bore 55 in the die block 53. As the mandrel 68 is thus driven to move downwardly with respect to the die assembly 34, the gears 31*a* and 31*b* respectively resulting from the lower two blanks 30*a* and 30*b* fast on the mandrel 68 are withdrawn downwardly out of the opening 48 in the lower backup member 47 into the bore 42 in the support block 41 with the gears resulting respectively from the third lowermost blank 30*c* and uppermost blank 30*d* retained in the bore 55 in the die block 53. As the mandrel 68 is further driven to move downwardly with respect to the die assembly 34, the lower one of the two gears 31*a* and 31*b* retained to the mandrel 68 is brought into abutting contact with the upper face of the chute member 69 and is removed from the mandrel 68. The upper one of the two gears 31*a* and 31*b* is thus prevented from being moved downwardly with the mandrel 68 and is removed from the mandrel 68 being moved downwardly with respect to the chute member 69. By the time when the mandrel 68 reaches the lower limit position thereof, the two gears 31*a* and 31*b* are thus admitted into the bore 42 in the support block 41 and are received on the chute member 69. The solenoid-operated fluid shut-off valve 73 is then actuated to open so that a jet stream of fluid under pressure is injected through the fluid passageway 72 into the bore 42 in the support block 41 and impinges upon the gears 31*a* and 31*b* on the chute member 69. The gears 31*a* and 31*b* on the chute member 69 are as a consequence forced to move from the bore 42 into the passageway 43 in the support block 41 and are thus withdrawn from the die assembly 34. Two gears are in these manners produced in a single cycle in which each of the punch assembly 35 and the punch assembly 35 is driven to move back and forth between the upper and lower limit positions thereof with respect to the die assembly 34.

Upon completion of the first cycle of operation, other two blanks 30*d* and 30*e* are put into the bore 56 in the bearing ring 54 with the punch assembly 35 held in the upper limit position thereof and the mandrel 68 held in the lower limit position thereof. The two subsequent blanks 30*d* and 30*e* thus put into the bore 56 in the bearing ring 54 are received on the upper one of the gears 31*c* and 31*d* respectively resulting from the blanks 30*c* and 30*d* remaining in the bore 55 in the die block 53, though not shown in the drawings. The mandrel 68 is then driven to move upwardly from the lower limit position to the upper limit position thereof and is thereby caused to extend through at least two of the total of four blanks including the blanks 30*c* and 30*d*. After the mandrel 68 is moved to the upper limit position thereof, the die assembly 34 is driven to move downwardly from the upper limit position toward the lower limit position. The gears 31*c* and 31*d* below the subsequent blanks 30*d* and 30*e* thus forced downwardly in the bores 55 and 56 in the die block 53 and bearing ring 54 are now passed through the bore 55 in the die block 53 similarly to the gears 31*a* and 31*b* produced in the preceding cycle of operation. A number of helical gears are produced by repetition of the second cycle of operation. While it has been described that a total of four blanks are put into the die assembly 34 and thus two of these blanks are deformed into gears in each cycle of operation, a total of five or more blanks may be put into the die assembly 34 so that three or more of these blanks are deformed into gears in each cycle of operation if desired. As an alternative, only one or two blanks may be put into the die assembly 34 and deformed into gears in each cycle of operation.

While, furthermore, the die assembly 34 and punch assembly 35 of the gear-forming apparatus embodying the present invention have been described as being arranged so that the punch assembly 35 is movable vertically with respect to the die assembly 34, the die assembly 34 and punch assembly 35 of a gear-forming apparatus according to the present invention may be arranged in such a manner that the punch assembly 35 is movable horizontally or in any other direction toward and away from the die assembly 34 which is held stationary. If the die assembly 34 and punch assembly 35 are arranged so that the punch assembly 35 is movable in a direction in which the delivery passageway 43 in the support block 41 of the die assembly 34 is inclined downwardly with respect to the floor surface S, the gear withdraw means of the gear-forming apparatus according to the present invention may consist of the chute member 69 alone, viz., the fluid passageway 72 in the support block 41 may be dispensed with. The fluid passageway 72 may also be dispensed with if the chute member 69 is arranged to be tiltable in the support block 41 and is provided with suitable compression springs adapted to drive the chute member 69 to incline with respect to the floor surface. The punch sleeve 64 forming part of the punch assembly 35 of the described embodiment may be replaced with any cylindrical member formed with a blind bore which is open in a direction in which the punch assembly 35 is to move toward the die assembly 34. A breather port may be formed in such a cylindrical member or the punch sleeve 64 in the described embodiment. While it has been described that the mandrel 68 is driven to move with respect to the die block 53, at least one of the mandrel 68 and the die block 53 may be driven to move with respect to each other according to the present invention.

What is claimed is:

1. A gear-forming apparatus, comprising:

a die block formed with an axial bore and a plurality of teeth radially projecting into the bore and having lead-in portions adjacent one axial end of said bore;

a pressing member movable downwardly into and upwardly out of said bore through one axial end of said bore;

an elongated mandrel movable upwardly into and downwardly out of said bore through the other axial end of the bore; said pressing member and said elongated mandrel being axially movable toward and away from each other; and gear withdraw means adapted to remove and withdraw a gear from said mandrel.

2. A gear-forming apparatus, comprising:

a die assembly comprising a support block formed with an axial bore and a passageway leading from the bore in the support block and open to the outside of the support block, a lower backup member fixed with respect to the support block and formed with an opening which is adjacent at one axial end thereof to the bore in the support block, a die block fixed with respect to the lower backup member and formed with an axial bore and a plurality of teeth radially projecting into the bore and having lead-in portions adjacent one axial end of the bore in the die block, the bore in the die block being open at one axial end thereof to the opening in the lower backup member through the other axial end of the opening, a bearing member fixed with respect to the die block and formed with an axial bore substantially aligned with and equal in diameter to the bore in the die block, the bore in the bearing member being open at one end thereof to the bore in the die block through the other end of the bore in the die block, and a guide block fixed with respect to said support block and formed with an axial bore substantially aligned with the respective bores in the die block and the bearing member;

a punch assembly movable forwardly toward and rearwardly away from said guide block and comprising a pressing member axially slidable downwardly into and upwardly out of the bore in said bearing member through the other axial end of the bore in the bearing member;

an elongated mandrel movable upwardly into and downwardly out of the bore in the die block through the bore in said guide block and the bore in the die assembly, said pressing member and said elongated mandrel being axially movable toward and away from each other; and gear withdraw means adapted to remove and withdraw gear from said bore in said support block through said passageway.

3. A gear-forming apparatus as set forth in claim 2, in which said gear withdraw means comprises a chute member partially positioned within said bore in said support block and partially extending through said passageway.

4. A gear-forming apparatus as set forth in claim 3, in which said gear withdraw means further comprises a valved fluid passageway leading from a source of fluid under pressure and terminating in the bore in said support block.

* * * * *